US006234453B1

(12) United States Patent
Block

(10) Patent No.: US 6,234,453 B1
(45) Date of Patent: May 22, 2001

(54) ROLLING DOOR WINCH APPARATUS

(76) Inventor: Michael W. Block, 5454 E. Oak St., Phoenix, AZ (US) 85008

( * ) Notice: Subject to any disclaimer, the term of this patent is extended or adjusted under 35 U.S.C. 154(b) by 0 days.

(21) Appl. No.: 09/372,840

(22) Filed: Aug. 12, 1999

(51) Int. Cl.[7] ..... B66D 1/36

(52) U.S. Cl. ..... 254/285; 254/286; 254/293; 254/336; 254/362; 254/398; 212/296; 212/348

(58) Field of Search ..... 254/278, 285, 254/284, 286, 288, 293, 332, 336, 339, 343, 356, 362, 394, 398, 399; 212/294, 295, 296, 230, 264, 348

(56) References Cited

U.S. PATENT DOCUMENTS

| | | | | |
|---|---|---|---|---|
| 326,336 | * | 9/1885 | Sandberg et al. | 212/296 |
| 1,428,887 | * | 9/1922 | Hescock | 254/285 |
| 1,685,144 | | 9/1928 | Austin . | |
| 1,699,587 | * | 1/1929 | Grenier | 212/230 |
| 1,754,873 | | 4/1930 | Blackwood . | |
| 1,861,191 | | 5/1932 | Russell . | |
| 2,671,638 | | 3/1954 | Allen . | |
| 2,714,434 | | 8/1955 | Peterson . | |
| 2,896,908 | | 7/1959 | Stone . | |
| 2,928,493 | * | 3/1960 | Clements | 212/264 |
| 2,983,474 | | 5/1961 | Hanna . | |
| 3,272,286 | | 9/1966 | Leduc . | |
| 3,891,184 | | 6/1975 | Fields . | |
| 4,508,316 | | 4/1985 | Millard . | |
| 4,616,225 | * | 10/1986 | Woudenberg | 212/294 |
| 5,078,364 | | 1/1992 | Harrell . | |

FOREIGN PATENT DOCUMENTS

| | | | | |
|---|---|---|---|---|
| 1126093 | * | 3/1962 | (DE) | 212/296 |
| 1281128 | * | 10/1968 | (DE) | 212/296 |
| 1371368 | * | 7/1964 | (FR) | 212/296 |
| 1548578 | * | 12/1968 | (FR) | 212/230 |
| 203365 | * | 4/1966 | (SE) | 212/296 |

* cited by examiner

*Primary Examiner*—Emmanuel M. Marcelo
(74) *Attorney, Agent, or Firm*—H. Gordon Shields

(57) ABSTRACT

Winch apparatus for raising and holding a rolling steel door includes a wheeled base with telescoping members extending upwardly from the base. A hand cranked winch raises and lowers the telescoping members, while a reversible electric motor is used to power a separate winch for raising and lowering a load secured to an arm extending outwardly from an innermost telescoping member. The arm is disposed against a building when the apparatus is in position to raise the rolling steel door for its installation.

19 Claims, 1 Drawing Sheet

ROLLING DOOR WINCH APPARATUS

BACKGROUND OF THE INVENTION

1. Field of the Invention

This invention relates to winches and, more particularly, to a winch for lifting and positioning rolling doors during the installation of the doors.

2. Description of the Prior Art

U.S. Pat. No. 1,685,144 (Austin) discloses a wall board lidder which includes a ratchet winch system for raising a platform on which wall board is disposed.

U.S. Pat. No. 1,754,873 (Blackwood) discloses a hoisting apparatus which includes a reversible electric motor and a screw shaft The apparatus includes a boom, and a cable on the boom is secured to a load. As the screw shaft is raised, the load is raised via the cable system. The cable is secured to the boom and extends downwardly and under a pulley on a fixed base, and back up to the boom and over pulleys to where it is fastened to the load. A reversible electric motor is used to raise and lower the screw shaft which in turn raises the boom and the load.

U.S. Pat. No. 1,861,191 (Russell) discloses a lift system which includes a cable wound about a drum and the drum is in turn secured to a gear which meshes with a worm gear. A shaft on the worm gear includes a crank for rotating the worm gear which in turn causes the cable drum to rotate for either reeling out the cable or reeling in the cable. The apparatus is disposed on a wheeled dolly. The apparatus is described as being a service truck truck for lifting refrigerators.

U.S. Pat. No. 2,671,638 (Allen) discloses telescoping members on a cable system for raising and lowering the telescoping members. The apparatus includes a base element to which are secured caster wheels for moving the apparatus.

U.S. Pat. No. 2,714,434 (Peterson) discloses a hoisting system for raising and lowering a platform. The apparatus includes a triangular support system, and a pair of generally parallel like elements of the triangle comprises a slide on which a platform moves.

U.S. Pat. No. 2,896,908 (Stone) discloses a telescoping mast hoisting apparatus which utilizes a chain drive.

U.S. Pat. No. 2,983,474 (Hanna) discloses another telescoping mast system which includes a triangular base and castor wheels secured to the base for moving the apparatus. A crank cable system is used for raising and lowering the telescoping members.

U.S. Pat. No. 3,272,286 (Leduc) discloses a hoist system having telescoping members disposed on a movable base. The telescoping members are raised and lowered by means of a screw jack rotated by a gearing system and a hand crank.

U.S. Pat. No. 3,891,184 (Fields) discloses a telescoping mast system which includes a movable base. Telescoping members are raised and lowered by a hand crank and a cable. The telescoping members include a fixed outer tube, a middle tube and an inner tube. A single cable is used to raise the two movable tubular members. The cable extend through pulleys on the middle tube and is secured to the inner tube. Accordingly, as the cable is shortened, both the inner tube and the middle tube move upwardly.

U.S. Pat. No. 4,508,316 (Millard) discloses a telescoping system utilizing a hand crank and a cable for lifting a pair of telescoping members. The telescoping members are disposed on a movable base and an outer fixed tube is secured to the base, while a pair of telescoping members nest within each other. The telescoping members include a middle member and an inner member, and a single cable is used to lift both telescoping members at the same time by means of a single cable. The single cable utilizes pulleys on the middle member and is secured to the upper portion of the inner member.

U.S. Pat. No. 5,078,364 (Harrell) discloses a lock system for locking a telescoping mast in a desired location. A single cable is used to raise the mast, and to raise a platform on which a load is disposed. The apparatus includes wheels for moving the apparatus to a desired location.

SUMMARY OF THE INVENTION

The invention described and claimed herein comprises a winch apparatus for lifting rolling steel doors during the installation process of the rolling door. A movable base includes stabilizing legs and wheels secured to the base frame disposed slightly above the base frame when the apparatus is in its use position, but the wheels are used for moving the apparatus into position by tilting the apparatus. Telescoping members are secured to the base and are extended to support the rolling door. The innermost telescoping member includes an arm, and a cable extends through the innermost telescoping member and through the arm. A lifting sling is secured to the outer end of the cable for lifting the rolling steel door into position. In the use environment, the arm is disposed against the building, thus providing stability for the apparatus. A reversible electric motor powers the winch for raising and lowering the lifting sling, while a hand driven winch and separate cable system are used to raise and lower the telescoping members.

Among the objects of the present invention are the following:

To provide new and useful winch apparatus;

To provide new and useful winch apparatus for lifting a rolling steel door;

To provide new and useful winch apparatus including a base and telescoping members secured to the base;

To provide new and useful portable winch apparatus including telescoping members and an arm extending outwardly from the telescoping members;

To provide new and useful winch apparatus including telescoping members and a cable system for raising the telescoping members and a separate cable system for lifting a load secured to an arm extending outwardly from one of the telescoping members; and To provide new and useful winch apparatus including wheels for moving the winch apparatus to a use environment and a base having stabilizing arms disposed adjacent to the wheels.

DESCRIPTION OF THE PREFERRED EMBODIMENT

Figure 1:
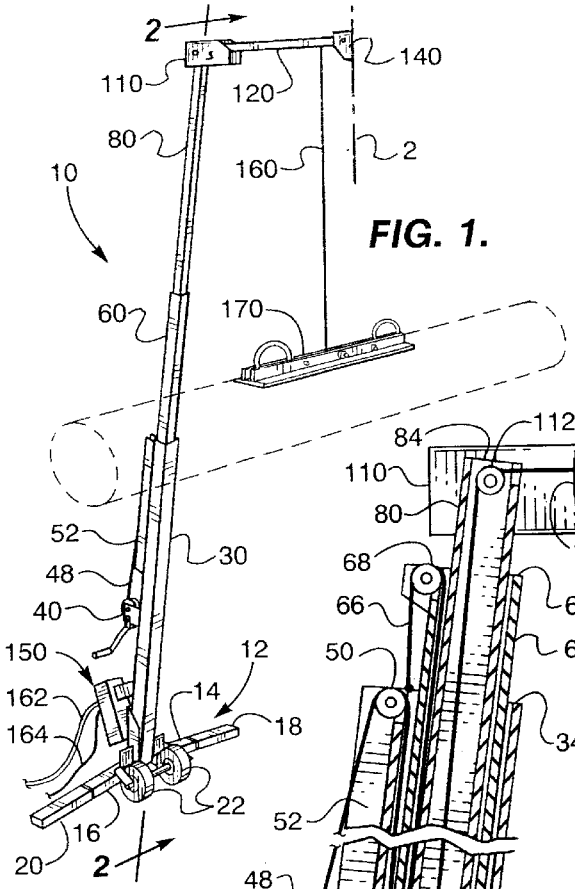
FIG. 1 is a perspective view of the apparatus of the present invention.

Winch apparatus 10 includes a base 12 having two fixed arms, a fixed arm 14 and a fixed arm 16. The fixed arms 14 and 16 extend outwardly from the base generally oppositely each other. A pivoting arm 18 is secured to the fixed arm 14, and a pivoting arm 20 is secured to the fixed arm 16. The pivoting arms 18 and 20 fold for convenience in storing the apparatus 10. In the use environment, such as suggested in FIG. 1, the pivoting arms 18 and 20 move outwardly on the fixed arms to provide outrigger stability for the winch apparatus 10.

Extending upwardly from the base 12 are three tubular members, including an outer fixed tube 30. Within the outer fixed tube 30 are two movable tubes, including a middle movable tube 60 and a movable inner tube 80. The three tubular members 30, 60, and 80 telescope together. In FIG. 1, they are shown extended, and they are similarly shown extended in FIG. 2.

Figure 2:
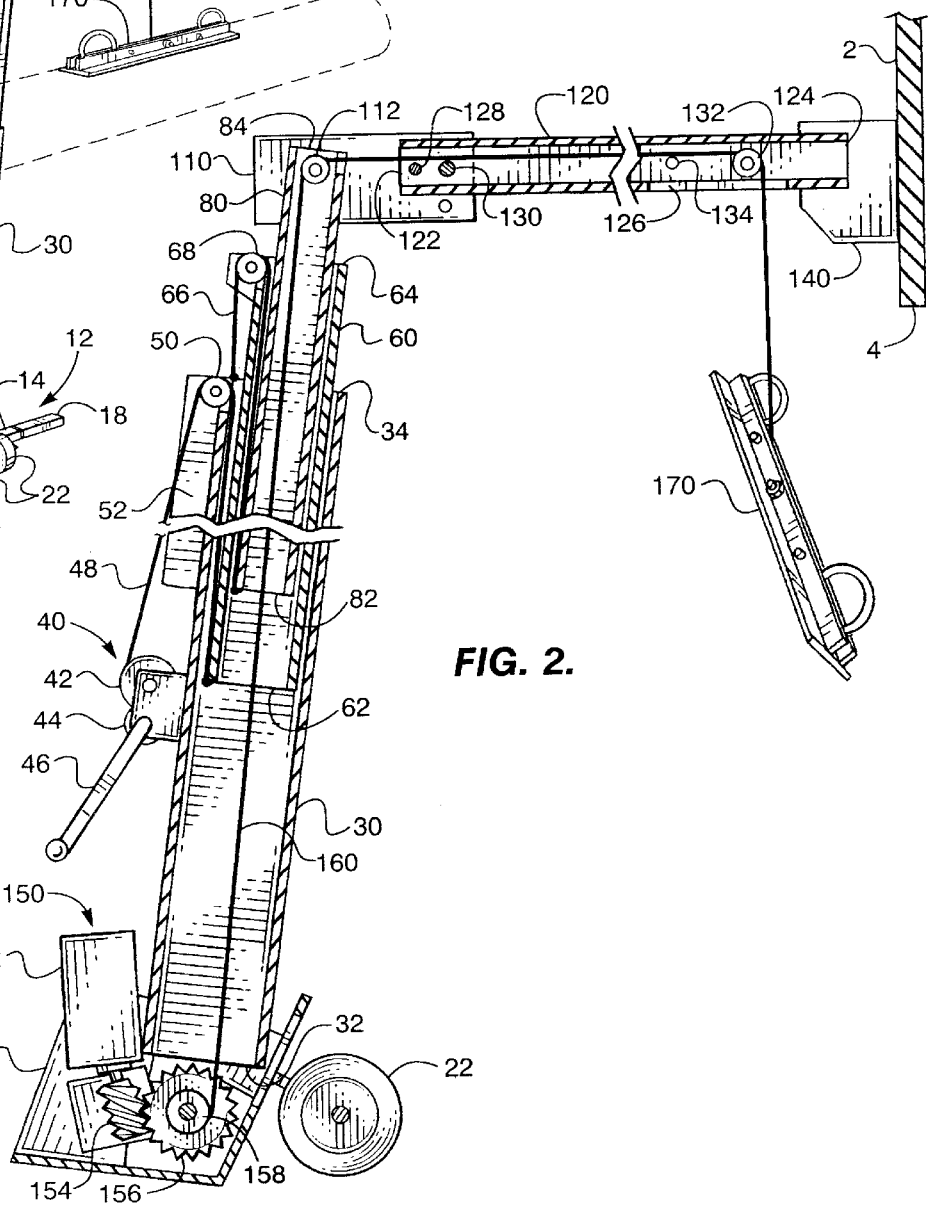
FIG. 2 is a view in partial section taken generally along line 2—2 of FIG. 1.

A pair of roller wheels 22 is also secured to the base 12. For maneuvering the apparatus 10 to a use position, the tubes 80, 60, and 30 are nested within each other, as will be discussed below, and tilted downwardly. The winch apparatus is pivoted downwardly onto its wheels 22 and moved into a use position. In the use environment, as indicated in FIG. 2, the apparatus 10 is moved to the position shown in FIG. 1, with the pivoting outrigger arms 18 and 20 moved outwardly to provide a relatively stable base.

A winch assembly 40 is secured to the outer fixed tube 30. The outer fixed tube 30 includes a bottom 32 and a top 34. The winch assembly 40 includes a drum 42 about which a cable 48 is disposed. The winch assembly 40 also includes a drive gear 44 which meshes with a gear on the drum 42. A handle 46 is appropriately secured to the drive gear 44. The cable 48 extends upwardly from the drum 42 to a pulley 50 secured adjacent to the top 34 of the fixed tube 30. The cable 48 then extends downwardly within the outer fixed tube 30 and is secured to the middle tube 60. A shroud 52 is disposed about the pulley 50. The shroud 52 is, of course, secured also to the outer tube 30.

The middle tube 60 includes a bottom 62 and a top 64. The cable 48 extends over the pulley 50 and to the bottom 62 of the middle tube 60, where it is secured. A second cable 66 is secured to the top 34 of the outer tube 30 and extends over a pulley 68 which is secured adjacent to the top 64 of the middle tube 60. The cable 66 then extends down the inside of the middle tube 60 and is secured to the inner tube 80. The inner tubular member 80 includes a bottom 82 and a top 84. The cable 66 is secured to the bottom 82.

When the handle 46 of the winch 40 is turned to take up the cable 48 by winding the cable onto the drum 42, the middle tube 60 is moved upwardly. As the middle tube 60 is moved upwardly, the cable 66, being fixed at one end to the top 34 of the fixed outer tube 30 and to the bottom 82 of the inner tube 80, causes the inner tube 60 to move upwardly. That is, with the cable 66 being fixed at both ends, movement of the middle tube 60 also causes an upward movement of the inner tube 80.

Appropriately secured to the outer end 84 of the inner tube 80 is a pair of support plates 110. A pulley 112 is appropriately journaled for rotation between the support plates 110 and within the upper portion of the inner tubular member 80.

Extending outwardly from the support plates 110 is a tubular arm 120. The tubular arm 120 includes an inner end 122 and an outer end 124. The inner end 122 is pivotally supported between the support plates 110 by a pivot pin 128. A locking pin 130 extends through aligned holes or apertures in the arm 120 and also in the plates 110.

Adjacent to the outer end 124 of the tubular arm 120 is a bottom slot 126. Above the slot 126 and extending through opposite sides of the arm 120 are two pairs of aligned apertures, of which one aperture or hole 134 is shown in FIG. 2. A pulley 132 is appropriately journaled for rotation on the arm 120 through the other pair of holes, outwardly from the pair of holes of which the hole 134 is shown. The two pairs of holes allow the pulley 132 to be located, as desired, with respect to the arm 120.

Extending outwardly from the tubular arm 120 and its outer end 124 are stabilizer plates 140. In FIGS. 1 and 2, the stabilizer plates 140 are shown disposed against a wall 2. Also shown in FIG. 2 is a door opening 4 in the wall 2. A rolling steel door will be located at the door opening 4.

A winch assembly 150 is appropriately secured to the base 12. The winch assembly 150 includes a reversible motor 152, the output shaft of which is secured to a worm gear 154. The worm gear 154 meshes with a drive gear 156 on a drum 158. A cable 160 is secured to the drum 158 and is rolled on and off of the drum 158 in response to operation of the motor 150. In FIG. 1, a power cable 162 and control cable 164 are shown extending outwardly from the winch assembly 150. The power cable 162 extends to an appropriate source of electrical power and the control cable 164 extends to a control device (not shown) having up, down, and off switch positions for controlling the motor 152. Such is well known and understood.

The cable 160 extends upwardly within the telescoping tubes 30, 60, and 80, and over the pulley 112. This is best shown in FIG. 2. From the pulley 112, the cable 160 extends outwardly through the arm 120 and over the pulley 132. The cable 160 then extends downwardly through the slot 126 in the bottom of the arm 120 and the cable 160 is appropriately secured to a sling 170. A rolling steel door or other load may be appropriately secured to the sling 170 for lifting and holding.

Actuation of the motor 150 allows the cable 160 to be unwound from the drum 158 and thus the sling 170 will move downwardly. A rolling steel door is then secured to the sling 170, and the motor 152 is then reversed to raise the sling 170 and its door (not shown) upwardly and adjacent to the opening 4 in the wall 2. The rolling steel door is then supported by the sling 170 and the cable 160 as the installation of the door is accomplished. The installation may be accomplished by only a single individual utilizing the winch apparatus 10 of the present invention.

In operation, as discussed above, the telescoping tubular members 60 and 80 are appropriately nested within the outer fixed tubular member 30 for storage and transporting. The arm 120 may be pivoted on the support plates 110 by removing the lock pin 130 and allowing the arm 120 to pivot on its pivot pin 128. With the cable 160 wound on the drum 158, the sling 170 will be disposed adjacent to the arm 120 and will be pivoted therewith.

The stabilizer elements 18 and 20 will be pivoted against the fixed arms 14 and 16, and the apparatus 10 may then be pivoted downwardly onto its roller wheels 22. In the folded, compact position, the apparatus 10 may be secured to a trailer or on a truck, as appropriate. When the trailer or truck arrives at the desired destination, the reverse procedure takes place. The winch apparatus 10 is moved into position on its roller wheels 22 until it is positioned adjacent to a door opening 4 in a wall 2. The arm 120 is pivoted outwardly and locked into place by its lock pin 130. The winch 40 is hand actuated by the handle 46 to raise the arms 60 and 80 relative to the fixed outer tube 30. When the telescoping members 60 and 80 are moved upwardly to the desired position relative to a door opening 4 of a wall 2, the apparatus is tilted inwardly until the stabilizer plates 140 are disposed against the wall 2. At this time, the motor 152 of the winch assembly 150 is actuated to lower the sling 170 to pick up a rolling steel door. The motor 152 is then reversed to raise the sling 170 and its attached rolling steel door. The sling and the door are then raised appropriately with respect to the door opening 4 for the installation of the door.

It will be noted that the winch apparatus 10 may be used to lift and hold other loads than merely the rolling steel door discussed herein, and it may be used to remove and lower loads, as well.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Winch apparatus for supporting an element adjacent to an opening in a wall comprising in combination:

base means for providing support;

a fixed tube secured to the base means and having a bottom end and a top end;

tubular means telescoping within the fixed tube;

first winch means for moving the tubular means relative to the fixed tube;

an arm secured to the tubular means and extending outwardly therefrom; and second winch means secured to the base below the bottom end of the fixed tube and including a cable extending through the fixed tube and the tubular means to the arm for raising and holding the element for installation.

2. The apparatus of claim 1 in which the base means includes a pair of wheels for moving the winch apparatus.

3. The apparatus of claim 2 in which the base means includes a pair of fixed arms secured to and extending outwardly from the base for providing stability.

4. The apparatus of claim 3 in which the base means further includes a pair of pivoting arms secured to the pair of fixed arms.

5. The apparatus of claim 1 in which the tubular means includes a pair of telescoping tubular members disposed within the fixed tube and movable relative thereto, including a middle tubular member having a bottom end and a top end, and an inner tubular member having a bottom end and a top end.

6. The apparatus of claim 5 in which the first winch means includes a first drum, a first pulley secured to the top end of the fixed tube, a second pulley secured to the top end of the middle tubular member, a first cable disposed about the first drum and extending over the first pulley and secured to the bottom end of the middle tubular member, and a second cable secured to the fixed tube and extending over the second pulley and secured to the bottom end of the inner tubular member.

7. The apparatus of claim 5 in which the arm is secured to the top end of the inner tubular member.

8. The apparatus of claim 7 in which the arm extends generally outwardly and is disposed against the wall for providing support for the winch apparatus.

9. The apparatus of claim 8 in which the second winch means includes a second drum, a third pulley at the top end of the inner tubular member, a fourth pulley on the arm remote from the third pulley, and a third cable disposed about the second drum and extending over the third and fourth pulleys.

10. The apparatus of claim 9 in which the second winch means further includes a reversible motor operatively connected to the second drum for winding the third cable onto and off of the second drum.

11. The apparatus of claim 10 in which the second winch means further includes a sling to which a load is secured, and winding the third cable onto the second drum lifts the load secured to the sling.

12. The apparatus of claim 7 in which the arm is pivotally connected to the inner tubular member.

13. Winch apparatus for lifting and holding a rolling door adjacent to an opening in a wall comprising in combination:

a base;

a fixed tube secured to the base and including an open bottom and an open top;

a first movable tube telescopingly disposed in the fixed tube;

a second movable tube telescopingly disposed in the first movable tube;

first winch means; including cable means secured to the fixed tube and to the first and second movable tubes for raising and lowering the first and second movable tubes relative to the fixed tube;

an arm secured to the second movable tube and extending outwardly from the second movable tube, including an outer end remote from the second movable tube and disposed against the wall for support;

second winch means secured to the base and extending to the arm, including a pulley secured to the arm between the outer end and the second movable tube, and a cable disposed over the pulley for raising and holding the rolling door adjacent to the opening in the wall.

14. The apparatus of claim 13 in which the cable of the second winch means extends through the fixed tube and the first and second movable tubes.

15. The apparatus of claim 14 in which the second winch means further includes a drum disposed beneath the fixed tube, and the cable is disposed about the drum and extends through the fixed tube and the movable tubes.

16. The apparatus of claim 13 which further includes a stabilizer plate secured to the outer end of the arm and disposed against the wall.

17. The apparatus of claim 13 which further includes a pair of fixed arms extending outwardly from the base to help stabilize the base.

18. The apparatus of claim 17 which further includes a pair of pivoting arms secured to the pair of fixed arms.

19. The apparatus of claim 13 in which the second winch means further includes a sling secured to the cable for holding the rolling door adjacent to the outer end of the arm.

* * * * *